United States Patent [19]

Reinmuth

[11] 4,376,738

[45] Mar. 15, 1983

[54] CARBURETION CONTROL APPARATUS

[76] Inventor: A. I. Reinmuth, 1022 N. 32nd St., Omaha, Nebr. 68131

[21] Appl. No.: 301,153

[22] Filed: Sep. 11, 1981

[51] Int. Cl.[3] ..... F02M 23/08

[52] U.S. Cl. ..... 261/63; 123/327; 123/587; 261/DIG. 19; 261/DIG. 67

[58] Field of Search ..... 261/DIG. 67, 63, DIG. 19, 261/56; 123/327, 587

[56] References Cited

U.S. PATENT DOCUMENTS

| | | | |
|---|---|---|---|
| 1,010,184 | 11/1911 | Schulz | 261/DIG. 67 |
| 2,029,142 | 1/1936 | Wemhoner | 261/DIG. 67 |
| 2,701,709 | 2/1955 | Brunner | 261/DIG. 67 |
| 2,752,136 | 6/1956 | Gardner | 261/DIG. 67 |
| 2,796,243 | 6/1957 | McDuffie | 261/DIG. 67 |
| 3,353,524 | 11/1967 | Sarto | 261/DIG. 19 |
| 3,364,909 | 1/1968 | Mick | 261/DIG. 19 |
| 3,374,991 | 3/1968 | Walker | 261/DIG. 19 |
| 3,795,237 | 3/1974 | Denton | 261/DIG. 19 |
| 3,852,381 | 12/1974 | Mick | 261/50 A |
| 3,939,232 | 2/1976 | Higashigawa | 261/72 R |
| 3,968,189 | 7/1976 | Bier | 261/39 A |
| 4,039,638 | 8/1977 | Hill | 261/72 R |
| 4,040,399 | 8/1977 | Meininger | 261/DIG. 67 |
| 4,062,910 | 12/1977 | Rogerson et al. | 261/34 A |

FOREIGN PATENT DOCUMENTS

| | | | |
|---|---|---|---|
| 412455 | 6/1934 | United Kingdom | 261/DIG. 67 |

*Primary Examiner*—Tim R. Miles

*Attorney, Agent, or Firm*—Henderson & Sturm

[57] ABSTRACT

An apparatus for use in conjunction with a conventionally carbureted internal combustion engine for improving fuel economy, which is connected to the carburetor float chamber and intake manifold of the engine and automatically lowers the fuel/air ratio during idle and other low-load engine operation by simultaneously reducing the pressure in the float chamber and allowing air to flow into the intake manifold.

6 Claims, 4 Drawing Figures

CARBURETION CONTROL APPARATUS

BACKGROUND OF THE INVENTION

Apparatus that control flow through the vents in carburetor float chambers are well known in the prior art, as can be seen by reference to U.S. Pat. Nos. 3,852,381; 3,939,232; 3,968,189; 4,039,638; and 4,062,910. The references cited are either difficult and expensive to install, either as original or after-market equipment, or do not provide as large an improvementin fuel economy as the instant invention.

With the increased price and decreased availability of gasoline in recent years, methods for decreasing the use of gasoline are continually being sought. One general method of increasing fuel economy is to utilize an air-fuel mixture in an engine that is as lean as possible. Carburetors have generally been designed to provide a rich fuel mixture to the engine at idle and low load to enhance drivability. If this mixture could be adjusted to be somewhat more lean, corresponding fuel savings could be realized.

The fuel consumption levels of typical older engines is quite high, making modifications to improve fuel economy quite attractive. The high price of new automobiles will inevitably lead to older autos, designed for use when petroleum in general was inexpensive, remaining in use for many years. The availability of simple, inexpensive devices to improve the fuel economy of these older autos is especially important to the working class people who drive them.

Even a manufacturer of new higher fuel economy automobiles needs to have a number of different design means available to build an auto of optimum efficiency. Many automobile models are now being sold worldwide, and the various markets require different levels of fuel economy, performance, and pollution control.

The instant invention was developed specifically as a solution to the hereinabove described problem whereby the functioning of a typical carburetor can be altered by the installation of a carburetor supply side fuel economy valve to provide a fuel-air mixture at all engine loads and speeds that is not overly rich, thus providing improved fuel economy. The performance and drivability of the auto would be harmed marginally at most in obtaining this significantly better fuel economy.

SUMMARY OF THE INVENTION

The present invention is a compound valve connected to the carburetor and intake manifold of a typical internal combustion engine. The compound valve operates in an economy position that allows air to flow into the intake manifold and decrease pressure in the float chamber of the carburetor by suitable connections whenever the pressure in the intake manifold falls below a predetermined level. When the pressure in the intake manifold is above the predetermined level, the compound valve is in a normal operating position where no additional air is allowed to flow into the intake manifold and atmospheric pressure is allowed in the float chamber. The compound valve switches between the two positions automatically by utilizing the difference between the pressure in the intake manifold and ambient atmospheric pressure as a driving force. In the preferred embodiment a diaphragm flexes in response to changing intake manifold pressure and moves a valve actuating rod.

An object of the instant invention is the provision of a fuel economy apparatus which when installed significantly increases the fuel economy of an engine utilizing a conventional carburetor.

A further object of the instant invention is the provision of a fuel economy apparatus which can be easily installed in either an older automobile as an after-market item, or in a new automobile as original equipment.

Still another object of the instant invention is the provision of a fuel economy apparatus which can be manufactured and installed at low cost, making the valve attractive to owners of older autos with poor fuel economy.

Yet another object of the instant invention is the provision of a fuel economy apparatus that is simple in its design, thereby requiring little maintenance.

These and other objects and advantages and novel features of the invention will become apparent from the following detailed description of the invention when considered in conjunction with the accompanying drawings.

DESCRIPTION OF THE PREFERRED EMBODIMENT

Figure 1:
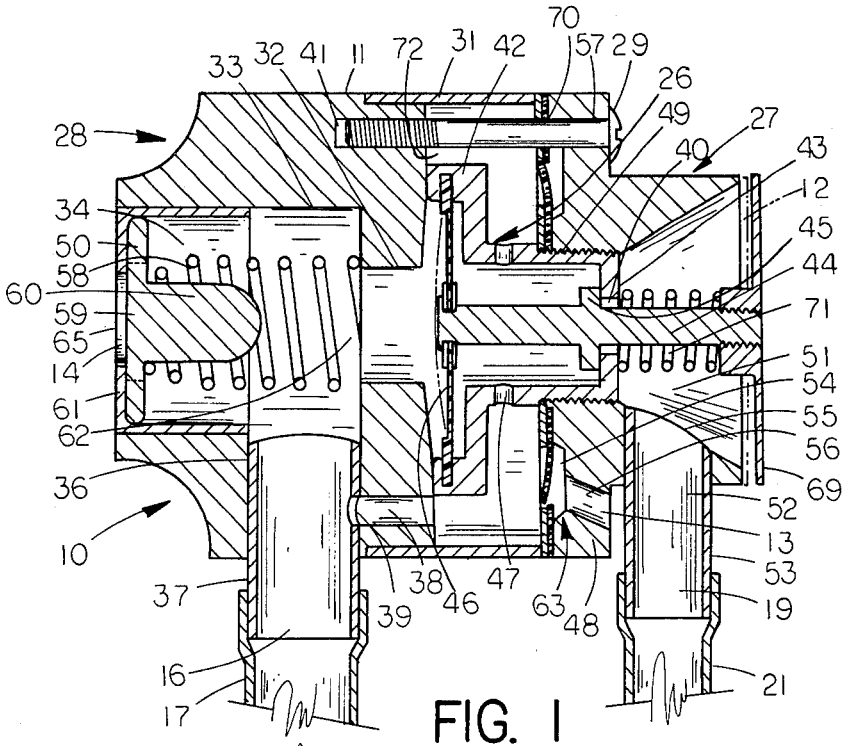
FIG. 1 is a longitudinal sectional view of the compound valve and connections of the present invention.
Figure 2:
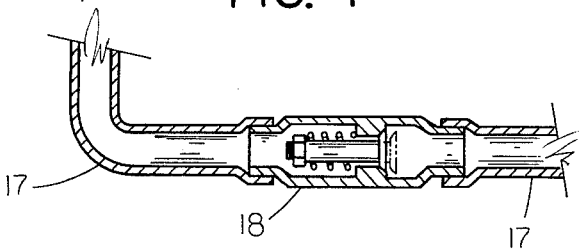
FIG. 2 is a reduced longitudinal sectional partial view of the connection of the present invention to an intake manifold.
Figure 3:
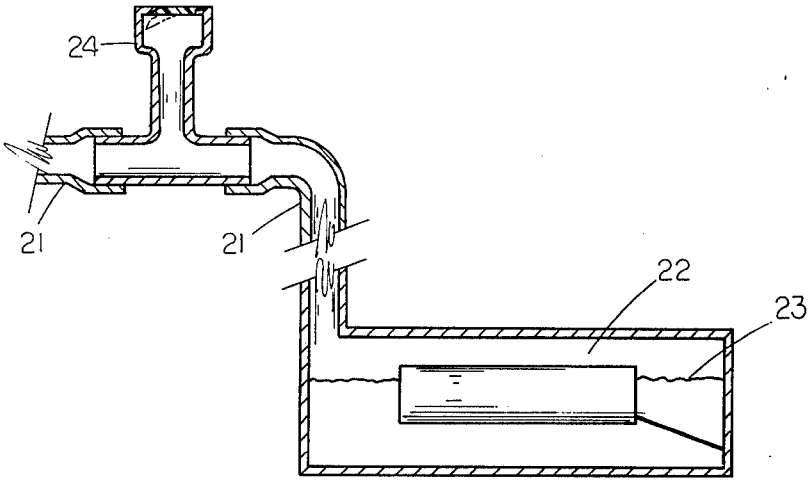
FIG. 3 is a reduced longitudinal sectional view of the connection of the present invention to a float chamber.

Referring now to the drawings wherein like reference numerals designate identical or corresponding parts throughout the several views, FIG. 1 illustrates a preferred embodiment of the compound valve of the present invention, shown generally at 10, for use on a typical carbureted gasoline engine. The compound valve 10 is preferably located in a space downstream from a carburetor air filter (not shown) of an internal combustion engine so that it is exposed to clean atmospheric pressure air. The compound valve 10 has a housing 11 with three inlet ports 12, 13 and 14 that open as required to atmospheric pressure. The valve housing 11 also has an outlet port 16 that is connected to the engine's intake manifold (not shown) by a first length of flexible tubing 17 that is interrupted by an on-off valve 18 (see FIG. 2). On-off valve 18 opens only when the pressure in the intake manifold is a predetermined amount lower than that at the outlet port 16. Finally, valve housing 11 has inlet-outlet port 19 that is connected by a second length of flexible tubing 21 to the carburetor's float chamber 22 above the fuel level 23 (see FIG. 3). This second length of flexible tubing 21 is interrupted by a float chamber air-bleed valve 24, also exposed to atmospheric pressure and which allows air to flow into the flexible tubing 21 in a restricted manner.

Figure 4:
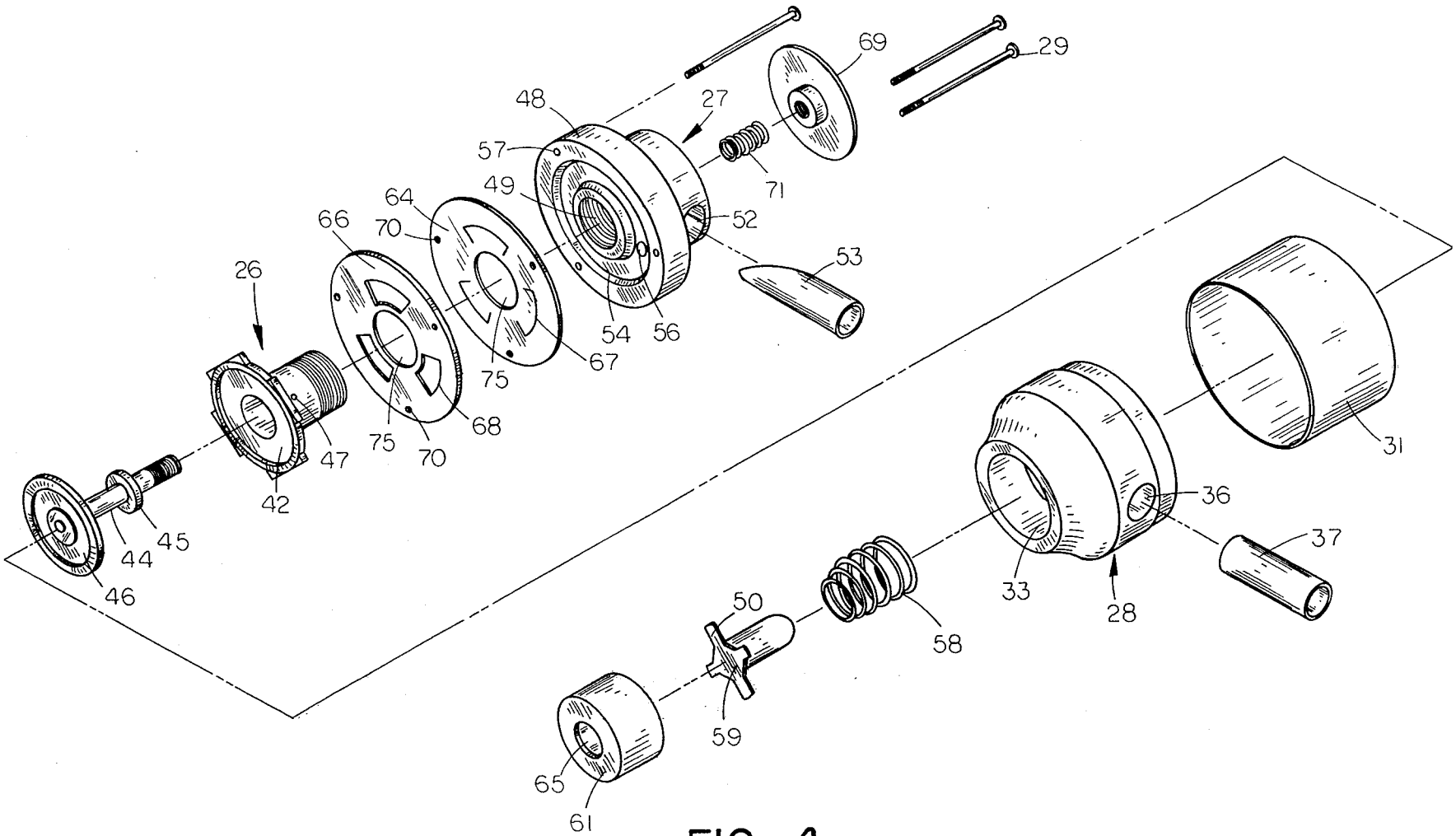
FIG. 4 is a reduced exploded perspective view of the components of the compound valve of the present invention.

Referring also to FIG. 4, compound valve housing 11 is comprised of three principal elements, each of which have shapes primarily comprised of various co-axial hollow cylindrical forms. These elements include a diaphragm supporting member, designated generally at 26, which is attached in a manner to be explained below, to an atmospheric pressure member designated generally at 27 which, in turn, is attached to and spaced apart from a low pressure member, designated generally at 28, by assembly screws 29 and a housing spacer 31, respectively. The resulting structure has diaphragm supporting member 26 located inside of housing spacer 31 and butted against low pressure member 28. Low pressure member 28 and atmospheric pressure member 27 are preferably made from cylindrical billets of aluminum which are bored and turned to obtain the required shapes (as can better be seen in FIG. 4). Diaphragm supporting member 26 is preferably made by casting an aluminum alloy and housing spacer 31 is a length of any type of thin wall tubing of sufficient strength and rigidity. Other materials such as injected molded plastic may also be appropriate for any of these elements.

The end of low pressure member 28 which faces atmospheric pressure member 27 is reduced in diameter a short distance to permit the appropriately sized housing spacer 31 to slip thereover, the outer diameter of spacer 31 being the same as that of the exposed main portion of low pressure member 28. Also in this end of low pressure member 28 there is a first co-axial bore 32 of sufficient diameter to allow free air flow. In the end of low pressure member 28 distal housing spacer 31 is a second co-axial bore 33 which is larger in diameter than first bore 32 and is of sufficient depth to connect the two. Limiter valve 34 is located within bore 33 and opens to atmospheric pressure whenever the pressure in bore 33 falls below a predetermined level. A third bore 36 is located in the side of low pressure member 28 axially normal thereto and is of sufficient depth and of appropriate location to connect with the interior end of second bore 33. Flexible rubber tubing 17 is connected to a first short length of metal tubing 37 which is press-fit within third bore 36. The exposed end of tubing 37 serves as outlet port 16 which is referred to hereinabove. A fourth bore 38 connects third bore 36 with the end of low pressure member 28 proximal the housing spacer 31 and is oriented parallel to the axis of member 28 and near its side. The diameter of fourth bore 38 is small, allowing only a predetermined amount of choked air flow, thereby functioning as an orifice. First short metal tube length 37 has an aperture 39 of the same diameter as fourth bore 38 that is located co-axially therewith. Lastly, three equidistant threaded bores 41 in the end of low pressure member 28 proximal housing spacer 31 are located parallel to its axis near the periphery of member 28. Bores 41 are of a diameter and thread pitch appropriate to receive housing assembly screws 29.

Diaphragm supporting member 26 has an outwardly extending flange 42 at its end proximal low pressure member 28 and an enclosing disc 43 with a co-axial aperture 40 at its other end. The exterior of supporting member 26 proximal enclosing disc 43 is threaded for attachment to atmospheric pressure member 27. Aperture 40 in enclosing disc 43 is of sufficient diameter for a linking rod 44 to move therethrough and still permit air flow through aperture 40 and around linking rod 44. Outwardly extending flange 42 has an outer diameter small enough not to interfere with air flow through the fourth bore 38 of low pressure member 28 when housing 11 is assembled. Also, outwardly extending flange 42 has a thickening of U-shaped cross section at its periphery proximal low pressure member 28 and with the opening of the "U" axially oriented. A diaphragm 46 with a thickened rim is press fit within the opening of the "U". The sides of the "U" are of a thickness sufficient to allow diaphragm 46 to flex without coming into contact with flange 42 or low pressure member 28. When housing 11 is assembled, the side of the U-shaped thickening proximal member 28 sealably butts thereagainst. Also, diaphragm supporting member 26 has two apertures 47 axially normal thereto proximal flange 42 for allowing air flow from within diaphragm supporting member 26 to the remaining space enclosed by housing spacer 31.

Atmospheric pressure member 27 has an outwardly extending flange 48 at its end proximal diaphragm supporting member 26. Flange 48 has the same outer diameter as housing spacer 31 and the exposed main portion of low pressure member 28. A first co-axial bore 49 is located in the end proximal flange 48 and is threaded and sized to receive the threaded end of diaphragm supporting member 26. A co-axial conical cavity 51 is located in the end of the member 27 distal flange 48, its diameter varying from just less than the outer diameter of member 27 at its end distal flange 48 to the same diameter as first bore 49 where cavity 51 and bore 49 join. The large open end of cavity 51 in the atmospheric pressure member 27 serves as the first inlet port 12 of housing 11. A second bore 52, located in the side of atmospheric pressure member 27 and oriented radially opens into the small end of conical cavity 51. Flexible rubber tubing 21 is connected to a second short length of metal tubing 53 which is press-fit within third bore 52. The exposed end of tubing 53 serves as inlet-outlet port 19 of housing 11 which is referred to hereinabove. The hollow space comprised of conical cavity 51 and second bore 52 is referred to hereinafter as atmospheric pressure chamber 55 of housing 11. Flange 48 of atmospheric pressure member 27 has a shallow annular channel 54 in its side distal cavity 51. A third bore 56 connects channel 54 with the side of the flange 48 proximal cavity 51 to allow atmospheric air to flow into channel 54. This fourth bore 56 serves as second inlet port 13 of housing 11 which is referred to hereinabove. Finally, three equidistant bores 57 in flange 48 oriented axially parallel thereto are positioned opposite the three equidistant bores 41 in low pressure member 28 and serve to locate and support housing assembly screws 29.

Limiter valve 34 located in second bore 33 of low pressure member 28 is comprised on a compression spring 58 for biasing a disc shaped gate 59 against a seat 61 which is press-fit into bore 33. The diameter of spring 58 is slightly larger in diameter than first bore 32 of low pressure member 28 and sits against the interior end of second bore 33 co-axial with both said bores. The other end of spring 58 presses against an adjacent side of gate 59. Gate 59 has a plurality of arms 50 from its perimeter which maintain its centered position within seat 61. Air may then flow between arms 50 and around gate 59 when it is lifted off of seat 61. Gate 59 also has a stem 60 of slightly smaller diameter than the inner diameter of spring 58 for keeping it centered with respect thereto. Seat 61 is in the shape of a hollow cylinder, its exterior end being enclosed and having an aperture 65 of slightly smaller diameter than gate 59. Limiter valve 34 is assembled so that the gate 59 is located within seat 61. The first, second and third bores 32, 33 and 36 respectively, of the low pressure member 28 form a low pressure chamber 62, and if the pressure therein falls below a predetermined level, limiter valve 34 will open, allowing ambient air to flow in. Limiter valve 34 serves as the third inlet port 14 which is referred to hereinabove.

When valve housing 11 is assembled, a housing air-bleed valve, designated generally at 63, is formed by sandwiching two flat discs 64 and 66, each having the same outer diameter as housing spacer 31, between flange 48 of the atmospheric pressure member 27 and housing spacer 31. Discs 64 and 66 each have three equidistant apertures 70 for allowing assembly screws 29 to pass therethrough, and a centered aperture 75 of a slightly larger diameter than the outer diameter of diaphragm supporting member 26. Disc 64, which is located adjacent atmospheric pressure member 27, is made of a flexible material and has three equidistant U shaped slits 67 (see FIG. 4) spaced between the three equidistant apertures 70. Slits 67 are located adjacent to channel 54 in flange 48 of atmospheric pressure member 27. The other disc 66 of air-bleed valve 63 is rigid and identical in shape to flexible disc 64 except that it has fan shaped apertures 68 corresponding to and aligned with U shaped slits 67. The space enclosed by sleeve 31 and diaphragm supporting member 26, and bounded by low pressure member 28 and atmospheric pressure member 27 is designated as air-bleed chamber 72. The slits in flexible disc 64 form flaps that can bend into fan-shaped apertures 68 in rigid disc 66 allowing restricted ambient air flow when the pressure in air-bleed chamber 72 is lower by a desired amount than atmospheric pressure.

Linking rod 44 is located within diaphragm supporting member 26 and atmospheric pressure member 27 and is attached by well known means at one end to the center of diaphragm 46 and at its other end to the center of a circular capping plate 69. Circular capping plate 69 is located adjacent to the exterior end of atmospheric pressure member 27 and has the same diameter. A second compression spring 71 surrounding linking rod 44 and located between enclosing disc 43 and capping plate 69 biases capping plate 69 away from the adjacent end of atmospheric pressure member 27. Rod 44 has an annular capping flange 45 located at about its mid-length and within diaphragm supporting member 26, such that capping flange 45 seats against the enclosing disc 43 when spring 71 urges capping plate 69 away from member 27. When linking rod 44 is in this position, circular capping plate 69 is spaced away from the end of atmospheric pressure member 27, opening conical cavity 51 to the atmosphere. This position (hereinafter referred to as the normal position and shown in FIG. 1 in solid lines) of the compound valve 10 allows the communication of atmospheric pressure with inlet-outlet port 19, resulting in normal carburetion. The dimensions of the various elements associated with linking rod must be such that, regardless of how it may be disoriented axially due to the flexing of diaphragm, capping plate 69 will close first inlet port 12 when in contact with it and capping flange 45 will close aperture 40 when in contact with it.

When the pressure in low pressure chamber 62 falls as a result of low intake pressure in the manifold causing on-off valve 18 to open, the air allowed into air-bleed chamber 72 by housing air-bleed valve 63 will provide a pressure drop across the diaphragm 46 causing it to flex towards chamber 62, thereby unseating the rod capping flange 45 and seating the circular capping plate 69. In this position (hereinafter referred to as the economy position and shown in phantom lines in FIGS. 1 and 2) the fuel/air ratio is reduced by allowing a limited predetermined level of low pressure to exist at the inlet-outlet port 19. Due to housing air-bleed valve 63 allowing a controlled flow of air into chamber 62, the restricted air flow through bore 38 maintains the pressure difference across diaphragm 46.

When the engine is operating under a moderate load compound valve 10 is in normal position. This position corresponds to normal carburetor operation with ambient atmospheric pressure existing in float chamber 22 by communication with the atmosphere through conical cavity 51 of atmospheric pressure member 27, second short length of tubing 53 and flexible tubing 21.

When the engine is operating at idle or under low load, such as would be present during a steady cruise, compound valve 10 is in the economy position. Operation of the engine at low loads results in an intake manifold pressure that is sufficiently lower than atmospheric pressure to open on-off valve 18. Limiter valve 34 will open if the pressure in chamber 62 becomes less than the predetermined operational level for limiter valve 34, thus limiting the extent to which the pressure in chamber 62 may be below atmospheric pressure. Then air in the low pressure chamber 62 will flow out of outlet port 16 of compound valve 10 to the intake manifold creating a pressure drop across diaphragm 46. This causes diaphragm 46 to flex away from the conical cavity 51, thus moving rod 44 and attached capping plate 69 with it and resulting in the closure of first inlet port 12.

Ordinarily, limiter valve 34 will be open whenever diaphragm 46 is so flexed, since it is desirable that valve 10 functions in the economy position within a narrow range of pressures below atmospheric pressure. The predetermined pressure level at which on-off valve 18 opens is such that valve 10 will also be in the economy position under deceleration conditions.

The pressure drop also causes air to flow through fourth bore 38 in low pressure member 28 from air-bleed chamber 72. As the air in air-bleed chamber 72 is exhausted, it is replenished in one manner by air flowing into second inlet port 13 and in another manner by flow through the annulus between the linking rod 44 and aperture 40 in enclosing disc 43 from atmospheric pressure chamber 55. Atmospheric pressure chamber 55 is in turn replenished with air by flow through the second length of flexible tubing 21 into the inlet-outlet port 19. This air originates from flow into float chamber air-bleed valve 24.

The operation of compound valve 10 in the economy position results in improved fuel economy as a result of two mechanisms. The first mechanism is the reduced fuel concentration in the fuel-air mixture caused by the reduced pressure in the float chamber 22 on the surface of gasoline 23. The second mechanism is the reduced fuel concentration in the fuel-air mixture caused by the introduction of air into the intake manifold from outlet port 16 of compound valve 10 which originates at second inlet port 13 and float chamber air-bleed valve 24. The pressure drops caused by flow through on-off valve 18 in first length of flexible tubing 17, fourth bore 38 in low pressure member 28, and aperture 40 around linking rod 44 and its capping flange 45, in connection with the air admitted by air-bleed valves 24 and 63, keep the pressure in float chamber 22 from falling below a predetermined level.

The compound valve 10 and its connections can be altered in many ways within the basic concept of the invention. On-off valve 18, limiter valve 34, and float chamber air-bleed valve 24 could be eliminated without completely impairing the beneficial effects of compound valve 10. Alternately, housing air-bleed valve 63 could be eliminated if rod capping flange 45 and circular capping plate 69 were not allowed to seat completely, thus allowing restricted air flow into air bleed chamber 72 at all times as required. Furthermore, the structural design of compound valve 10 could be altered and still provide the same basic automatic mechanical operation of reducing pressure in the float chamber 22 and simultaneously admitting additional air into the intake manifold whenever the pressure there was sufficiently low.

Obviously, numerous modifications and variations of the present invention are possible in light of the above teachings. It is therefore to be understood that within the scope of the appended Claims, the invention may be practised otherwise than as specifically described herein.

I claim:

1. A carburetion control apparatus for an internal combustion engine having a conventional carburetor with a float chamber in which the level of the fuel is controlled to determine the rate of flow through an orifice into the intake manifold of the engine, the improvement comprising:

a compound valve housing;

means for forming an atmospheric pressure chamber within said housing having an inlet port opening to atmosphere, and an inlet-outlet port connected by tubing to the float chamber above the fuel level;

means for forming a low pressure chamber within said housing having a limiter valve means within an inlet port opening to atmosphere, said limiter valve biased against atmospheric pressure a predetermined amount, and an outlet port connected by tubing to the intake manifold;

means for forming an air bleed chamber within said housing, said air bleed chamber interconnecting said atmospheric pressure chamber and said low pressure chamber, and having an air bleed inlet port opening to atmosphere;

means for supporting a diaphragm within said air bleed chamber, the low pressure side of the diaphragm facing said low pressure chamber and its high pressure side facing said atmospheric pressure chamber, said diaphragm supporting means having at least one aperture therein connecting the high pressure side of the diaphragm with said air bleed chamber;

means for forming a bore within said housing connecting said low pressure chamber and the high pressure side of the diaphragm through said air bleed chamber and said at least one aperture;

means for linking the diaphragm to a means for capping the atmospheric pressure chamber inlet, said capping means having means for biasing it away from said inlet and said linking means having mounted thereon a means for capping the interconnection between said atmospheric pressure chamber and said air bleed chamber; and an on-off valve mounted within the tubing to the intake manifold, said on-off valve opening only when the manifold pressure is a predetermined amount less than that at the low pressure chamber outlet port, whereby the diaphragm will simultaneously uncap the interconnection between the atmospheric pressure chamber and the air bleed chamber and cap the atmospheric pressure chamber inlet when pressure at the low pressure chamber outlet port is less than that at the low pressure chamber inlet port by a pre-determined amount thus reducing pressure in the fuel chamber and increasing air flow to the intake manifold.

2. The carburetor control apparatus of claim 1 further comprising means for restricting the air flow through said air bleed chamber inlet port by an amount relative to the amount by which the pressure in said air bleed chamber is less than atmosphere.

3. The carburetion control apparatus of claim 1 or 2 wherein the diameter of said bore is small enough to function as an orifice.

4. The carburetion control apparatus of claim 1 or 2 further comprising an air-bleed valve mounted in an inlet port in the tubing connected to the float chamber, whereby restricted air can enter the tubing from the atmosphere.

5. The carburetion control apparatus of claim 1 wherein the diameter of said bore is small enough to function as an orifice and further comprising an air bleed valve mounted in an inlet port in the tubing connected to the float chamber, whereby restricted air can enter the tubing from the atmosphere.

6. The carburetion control apparatus of claim 5 further comprising means for restricting the air flow through said air bleed chamber inlet port by an amount relative to the amount by which the pressure in said air bleed chamber is less than atmosphere.

* * * * *